US006499711B1

(12) United States Patent
Hubmann et al.

(10) Patent No.: US 6,499,711 B1
(45) Date of Patent: Dec. 31, 2002

(54) DISPENSER WALL BRACKET

(75) Inventors: Curtis Hans Hubmann, Racine, WI (US); Elizabeth Anne Slater, Cambs (GB); Matthew Egerton Young, Cambs (GB); Reuben Wu, Saffron Walden (GB)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 09/973,236

(22) Filed: Oct. 9, 2001

(51) Int. Cl.[7] ..... A47K 1/08
(52) U.S. Cl. ..... 248/311.2
(58) Field of Search ..... 248/75, 79, 65, 248/314, 311.2, 309.1, 312; 222/181.3, 181.2; 220/480, 481

(56) References Cited

U.S. PATENT DOCUMENTS

| | | | | | |
|---|---|---|---|---|---|
| 2,153,156 | A | * | 4/1939 | Pollnow | 222/180 |
| 3,035,731 | A | * | 5/1962 | Schifter | 215/100 |
| 3,191,819 | A | | 6/1965 | Smith | 222/465 |
| 3,837,013 | A | * | 9/1974 | Davis et al. | 248/274.1 |
| 3,964,708 | A | * | 6/1976 | Reeves | 211/89.01 |
| 4,043,510 | A | * | 8/1977 | Morris | 239/322 |
| 4,875,652 | A | * | 10/1989 | Bosse et al. | 184/105.1 |
| 4,957,218 | A | * | 9/1990 | Ford, Jr. | 222/1 |
| 5,005,790 | A | * | 4/1991 | Harris, III | 248/213 |
| 5,222,633 | A | * | 6/1993 | Blake | 222/179 |
| 5,259,557 | A | | 11/1993 | Spriggs et al. | 239/304 |
| 5,363,869 | A | * | 11/1994 | McDowell | 134/104.2 |
| 5,449,137 | A | * | 9/1995 | Bell et al. | 215/396 |

OTHER PUBLICATIONS

Seven pages of a 1997 S. C. Johnson & Son, Inc. brochure entitled "The Power Tool for Cleaning" showing a wall mounted dispenser on p. 1 and the back page.

* cited by examiner

*Primary Examiner*—Ramon O. Ramirez
*Assistant Examiner*—Kofi Schulterbrandt
(74) *Attorney, Agent, or Firm*—Neil E. Hamilton; Warren R. Bovee; Renee J. Rymarz

(57) ABSTRACT

A dispensing assembly wall bracket for mounting an operable dispensing assembly to an essentially vertical surface. The bracket includes a base fixable to the vertical surface, and defining a plane which is substantially parallel to the vertical surface when the base is fixed thereto. A fitting is fixed to the base, and has an inlet and an outlet. The inlet defines an axis substantially parallel to the plane, and the outlet defines an axis which intersects the inlet axis. At least one support arm extends from the base, and has a proximal end fixed to the base and a distal end. A receptacle is supported by the support arm distal end, and aligned with the outlet axis, wherein a dispensing assembly having an inlet received in the receptacle is positioned for connecting the dispensing assembly inlet to the fitting outlet.

19 Claims, 10 Drawing Sheets

DISPENSER WALL BRACKET

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

The present invention relates to wall brackets, and more particularly to wall brackets for use with a fluid dispensing assembly.

Dispensing assemblies which dispense chemical concentrates mixed with water typically include a container containing the concentrate and a valve assembly fixed to the bottle. Pressurized water, for example supplied by a hose, connected to the valve assembly flows through the valve assembly, and draws the concentrate into the valve assembly which mixes the water and concentrate in a predetermined ratio. The stream of water and concentrate exits the valve assembly through a nozzle which can be designed for spraying a mist of the mixture into the atmosphere, directing the mixture into another container, and the like.

The dispensing assembly is often used to fill another container with the mixture. Filling another container often requires lifting the dispensing assembly, or attaching tubing, or another hose, to the dispensing assembly spout, such that the mixture exiting the valve assembly is directed into the other container. Therefore, it is desirable to maintain the operable dispensing assembly a distance above the floor for ease of operation.

A facility may also have a plurality of dispensing assemblies which are used to fill buckets and other containers with the diluted mixture. If the plurality of dispensing assemblies are each connected to a source of water by a separate hose, the hoses can get tangled and crimped which degrades the operation of the affected dispensing assembly. Therefore, a need exists for a means to supply a plurality of dispensing assemblies in an orderly fashion.

SUMMARY OF THE INVENTION

The present invention provides a dispensing assembly wall bracket for mounting an operable dispensing assembly to an essentially vertical surface. The bracket includes a base fixable to the vertical surface, and defining a plane which is substantially parallel to the vertical surface when the base is fixed thereto. A fitting is fixed to the base, and has an inlet and an outlet. The inlet defines an axis substantially parallel to the plane, and the outlet defines an axis which intersects the inlet axis. At least one support arm extends from the base, and has a proximal end fixed to the base and a distal end. A receptacle is supported by the support arm distal end, and aligned with the outlet axis, wherein a dispensing assembly having an inlet received in the receptacle is positioned for connecting the dispensing assembly inlet to the fitting outlet.

A general objective of the present invention is to provide a wall bracket which supports a dispensing assembly which is operable while mounted on the bracket. This objective is accomplished by providing a wall bracket which includes at least one support arm which can support the dispensing assembly and supplies a fitting for connecting the dispensing assembly to a fluid source for dispensing assembly operation.

Another objective of the present invention is to provide a wall bracket which is easily connectable to a dispensing assembly. This objective is accomplished by providing a wall bracket with a receptacle which guides a portion of the dispensing assembly for connecting the dispensing assembly to a fluid source.

Yet another objective of the present invention is to provide an assembly which can be connected in series to provide a plurality of operable dispensing assemblies. This objective is accomplished in some embodiments by providing an additional outlet for connecting to another wall bracket.

This and still other objectives and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
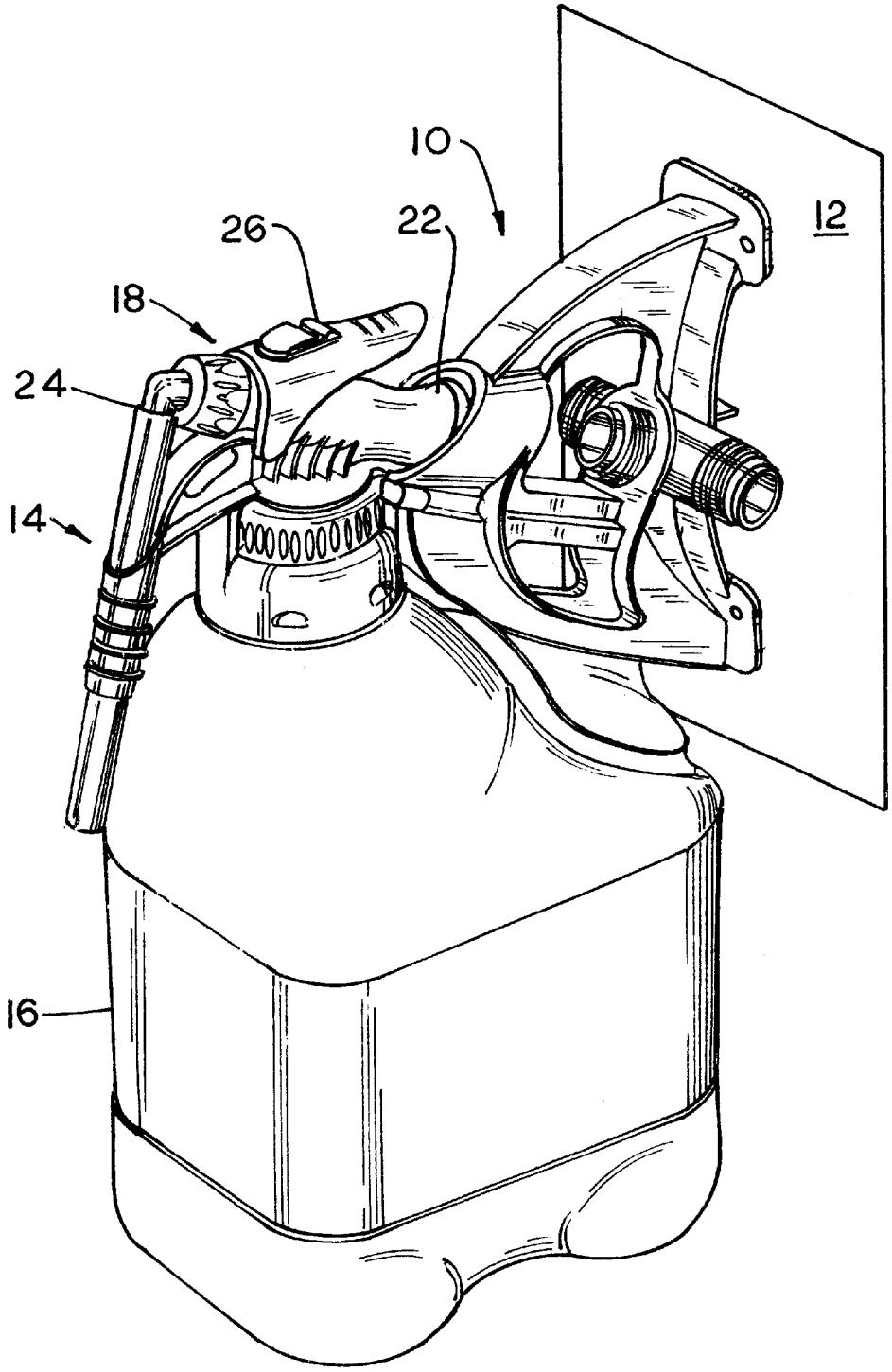
FIG. 1 Is a perspective view of a dispensing assembly wall bracket incorporating the present invention, and supporting a dispensing assembly.
Figure 1A:
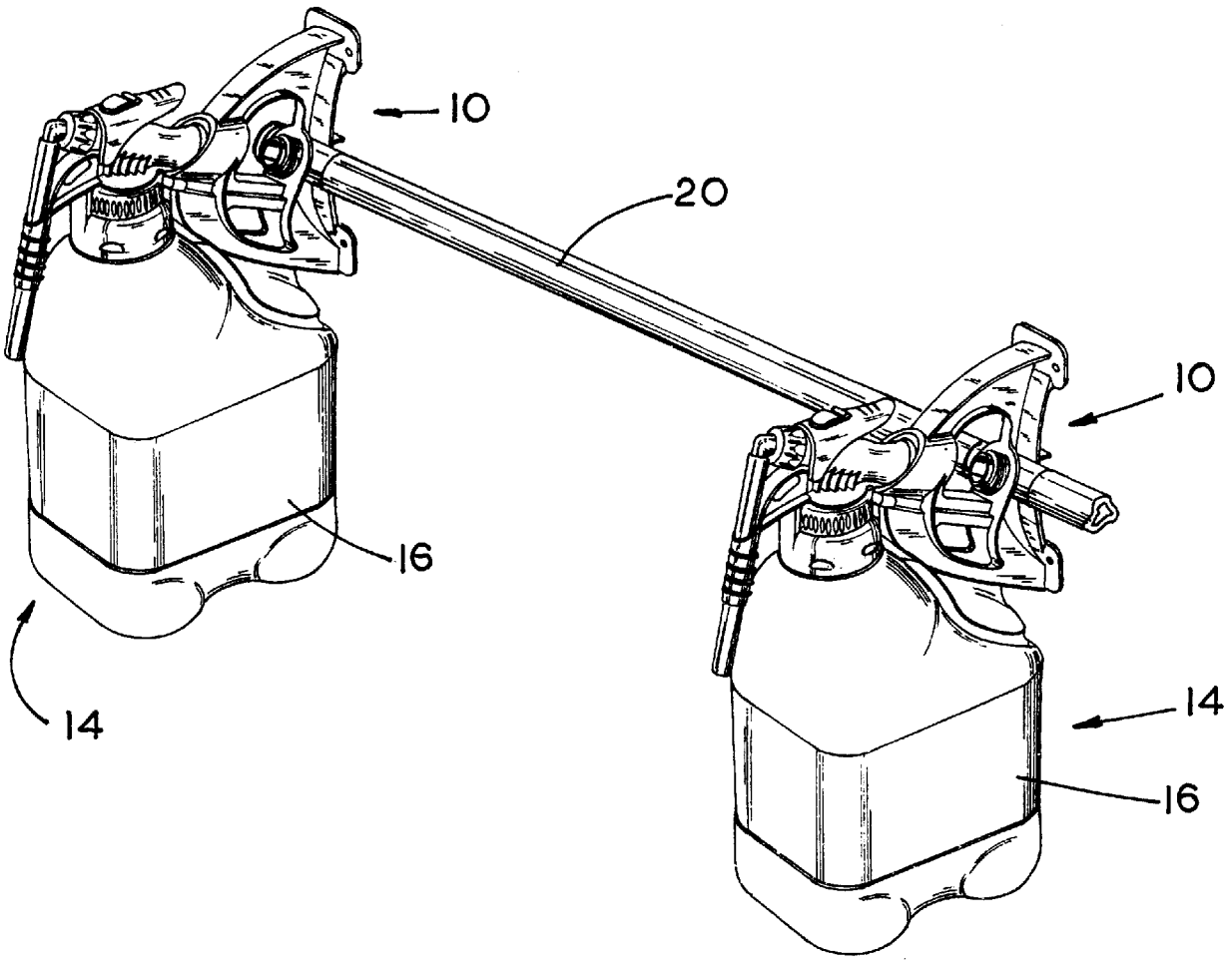
FIG. 1*a* is a perspective view of two wall brackets of FIG. 1 connected in series.
Figure 2:
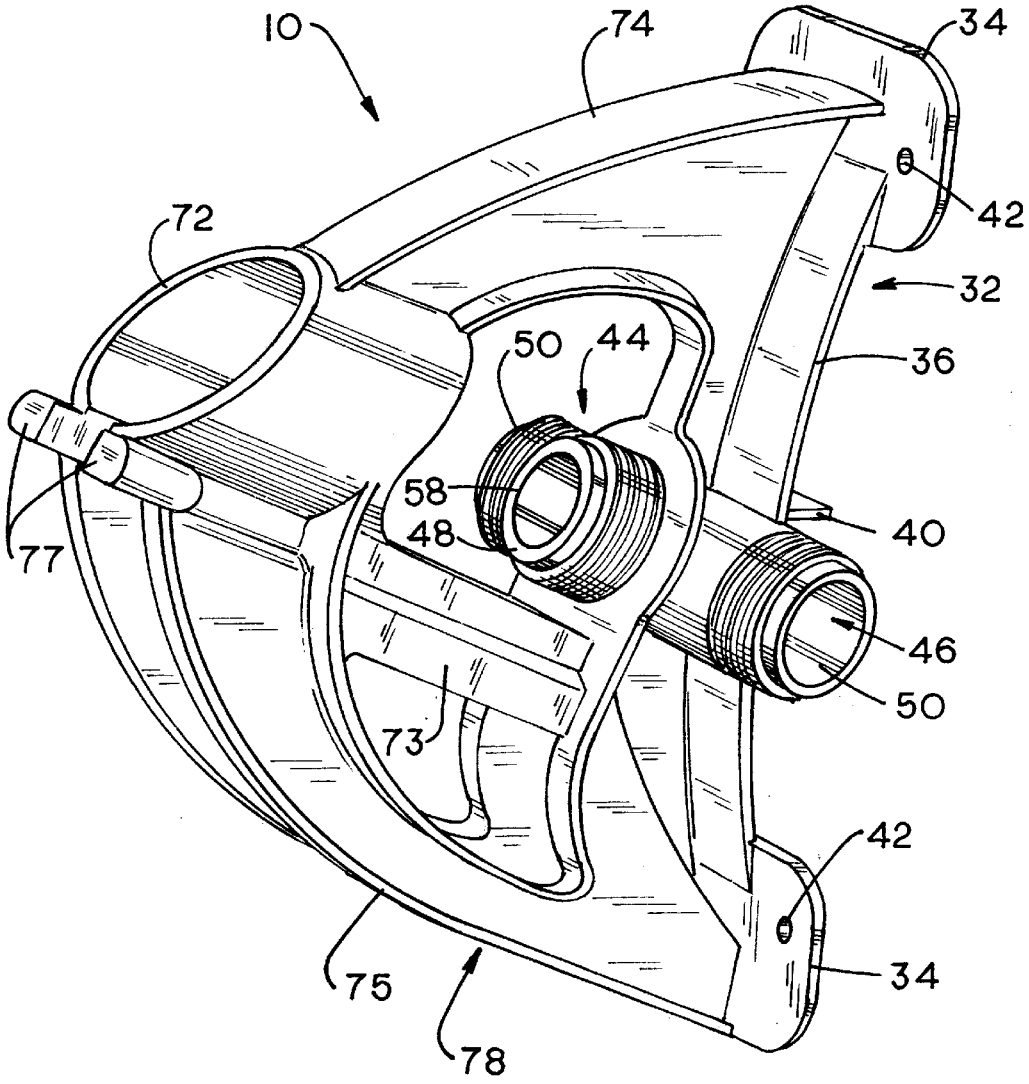
FIG. 2 is a perspective view of a dispensing assembly wall bracket incorporating the present invention.
Figure 3:
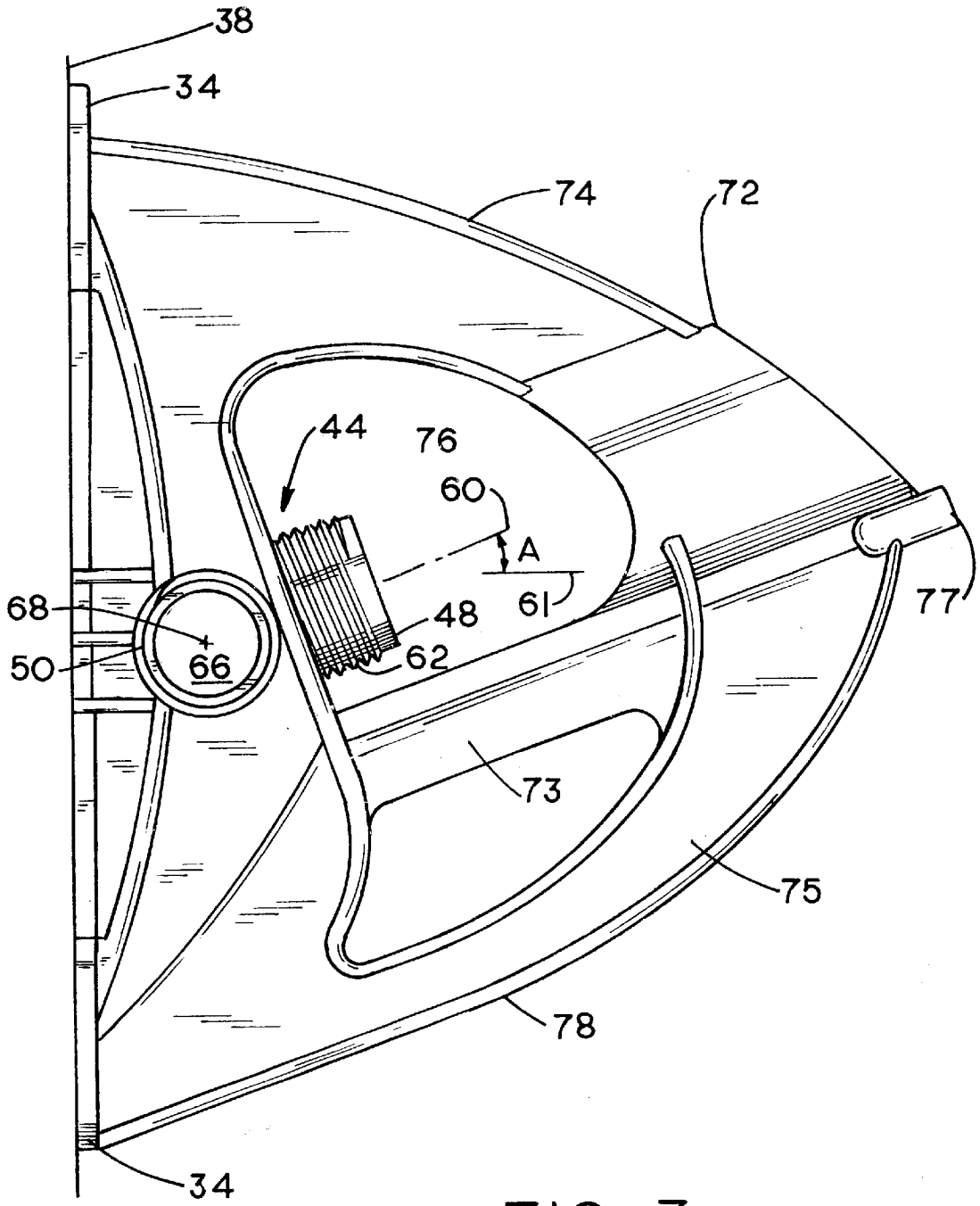
FIG. 3 is a side view of the wall bracket of FIG. 1.

Referring to FIG. 1, a wall bracket 10 mounted to a vertical surface 12, such as a wall, supports a dispensing assembly 14 above the floor. The wall bracket 10 supplies a first fluid, such as water, to the dispensing assembly 14 for mixing with a second fluid, such as a concentrate, disposed in a container 16 forming a part of the dispenser assembly 14. The wall bracket 10 easily connects and disconnects from the dispensing assembly 14 for ease of use, and can be connected in series with other wall brackets 10, such as shown in FIG. 1*a*, to supply the water to a plurality of dispensing assemblies 14 supported above the floor.

Figure 4:
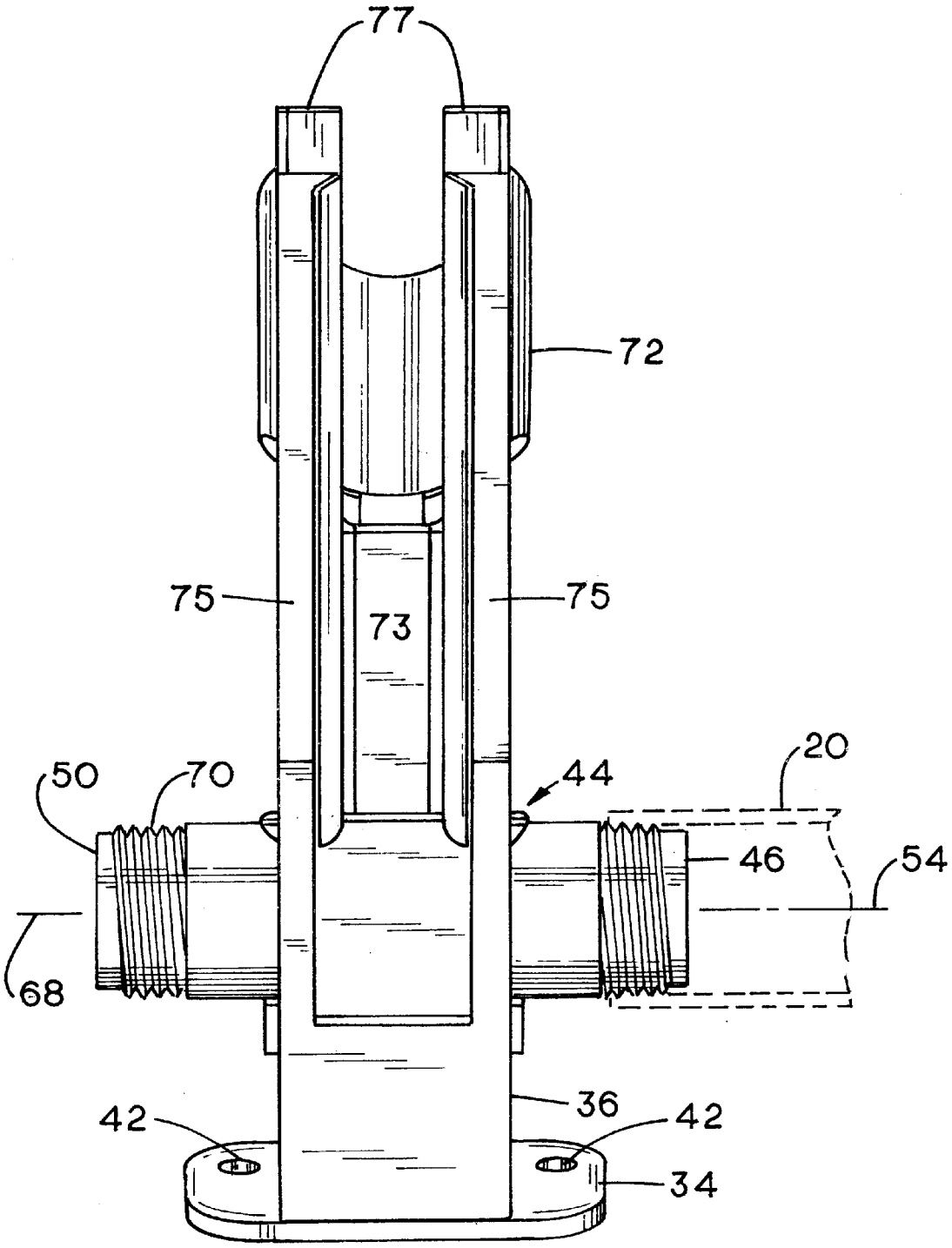
FIG. 4 is a bottom view of the wall bracket of FIG. 1.
Figure 5:
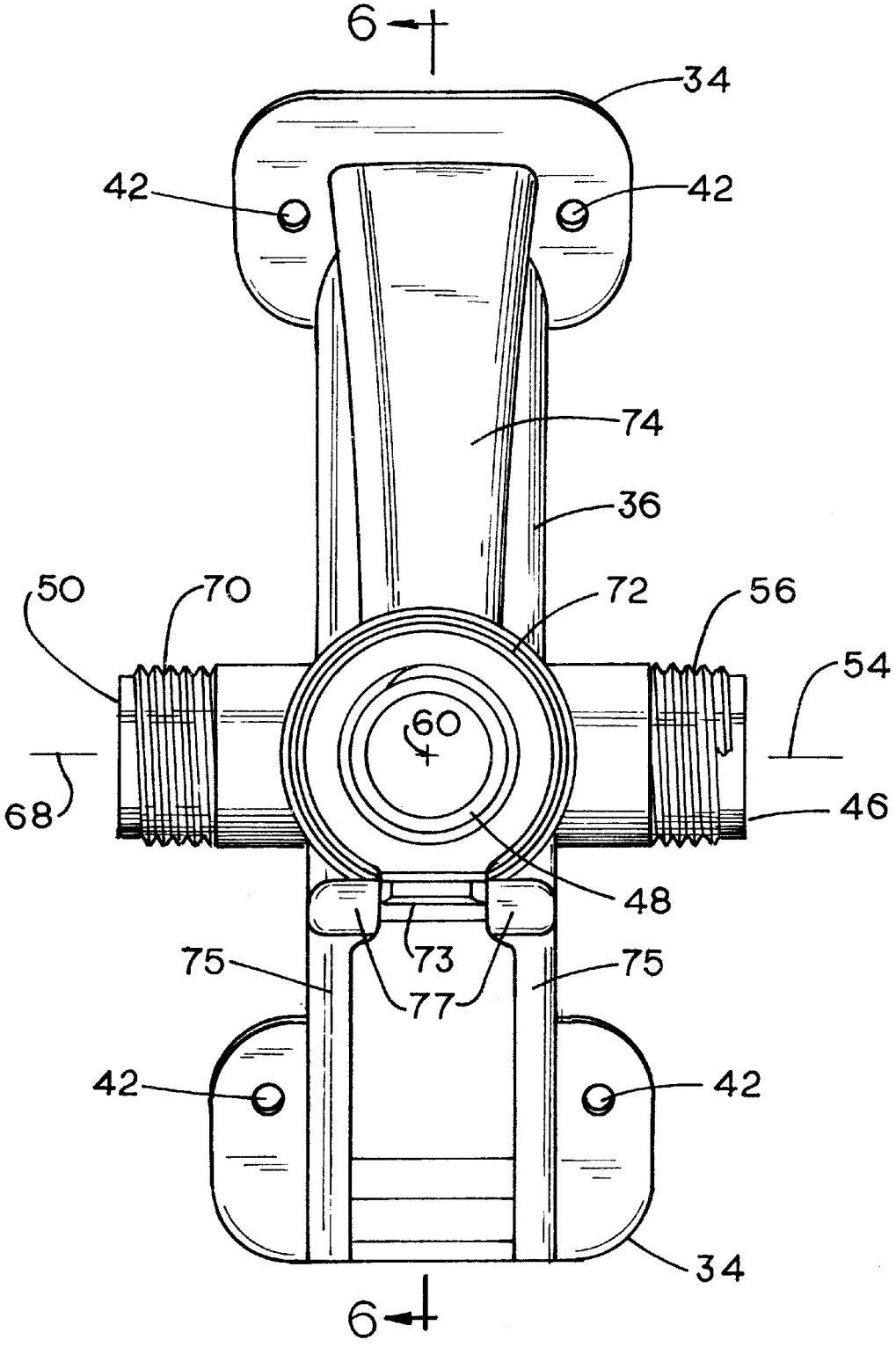
FIG. 5 is a front view of the wall bracket of FIG. 1.
Figure 6:
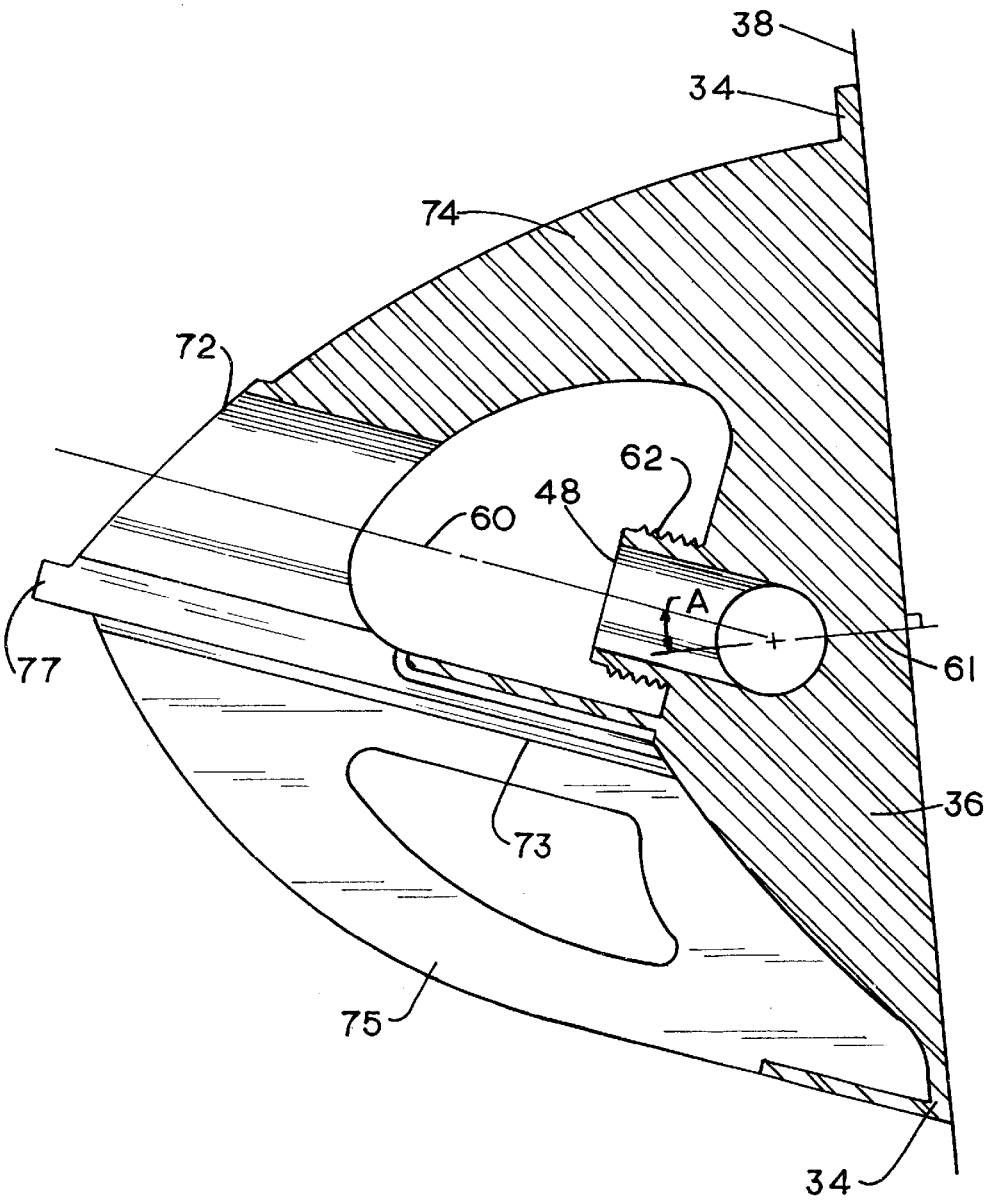
FIG. 6 is a cross sectional view along line 6—6 of FIG. 5.

The dispensing assembly 14 includes the container 16 defining a volume for holding the concentrate, which is dispensed through a valve assembly 18. The valve assembly 18 is detachably fixed to the container 16, and is connectable by a fluid conduit 20 (shown in FIG. 4), such as a rigid tube, a flexible hose, and the like, to a source of the pressurized water.

The container 16 can be any container known in the art which defines a volume for holding the concentrate, and has an opening which provides access to the concentrate in the volume. Preferably, a neck extends outwardly from the opening for fixing the valve assembly 18 thereto. Most preferably, the neck has eternal threads which engage internal threads formed in the valve assembly 18 to detachably fix the valve assembly 18 to the container 16 over the container opening.

The valve assembly 18 defines a passageway therethrough, and mixes the concentrate and water in the passageway. Preferably, the valve assembly 18 includes an inlet 22 disposed at one end of the passageway and a nozzle 24 disposed at the opposing end of the passageway. The inlet 22 is sealingly connected to the fluid conduit 20 supplying the water to the valve assembly 18, and the concentrate enters the passageway through a tube extending through the opening in the container 16. Valve members disposed in the passageway control the flow of the fluids through the passageway and out of the nozzle 24. A trigger 26 operatively connected to the valve members control the flow of fluids through the passageways by moving the valve members between an open position and a closed position.

As shown in FIGS. 2–6, a preferred dispensing assembly wall bracket 10 includes a base 32 having a pair of mounting pads 34 connected by an arcuate body 36. The two mounting pads 34 engage the wall, and define a plane 38 substantially parallel to the wall when the base 34 is mounted thereto. Ribs 40 extending from the body 36 toward the plane 38 can be provided to increase the rigidity of the body 36 for mounting the dispensing assembly 14 in the bracket 10. Although a pair of mounting pads 34 are shown in FIGS. 2–6, a wall bracket having a single mounting pad, such as a mounting plate formed as an integral part of the body, such as shown in FIG. 1, or a plurality of mounting plates, is within the scope of the present invention.

Apertures 42 formed in the pads 34 receive fasteners, such as bolts, screws, and the like, for fixing the base to the wall. The fasteners are slipped through the apertures 42, and engage the vertical surface to fix the bracket 10 to the vertical surface. Although fixing the bracket 10 to the wall using bolts or screws is disclosed, other methods known in the art for fixing brackets to walls can be used, such as by using adhesives, and the like, without departing from the scope of the present invention.

A fitting 44 is formed as an integral part of the body 36, and supplies the water to the dispensing assembly 14. The fitting 44 includes an inlet 46, a dispensing assembly supply outlet 48, and a connecting outlet 50. The inlet 46 is in fluid communication with the water source, the supply outlet 48 connects to the dispensing assembly 14 in order to operate the dispensing assembly 14 while mounted in the bracket 10, and the connecting outlet 50 can be connected to another fitting, dispensing assembly, or capped. Although forming the fitting 44 as an integral part of the body 36 is preferred, the fitting 44 can be fixed to the body 36 using methods known in the art, such as welding, adhesives, bolting, and the like, without departing from the scope of the present invention.

The inlet 46 is a cylindrical stub having an opening 52, and defines an axis 54 extending substantially perpendicular to the plane 38, and thus the wall. The inlet 46 extends along the axis 54, and includes external threads 56 for connecting to the fluid conduit 20. Although external threads 56 are preferred, the inlet 46 can be adapted for connecting to the fluid conduit 20 using methods known in art, such as using a quick disconnect coupling, hard piping, and the like.

The dispensing assembly supply outlet 48 and the connecting outlet 50 are in fluid communication with the fitting inlet 46. The supply outlet 48 supplies the water to the dispensing assembly 14, and is a cylindrical stub with an opening 58. The supply outlet 48 defines an axis 60 extending substantially perpendicular to the inlet axis 54. External threads 62 formed on the supply outlet 48 engage a quick disconnect coupling (such as designated by reference number 64 in FIGS. 7–9) for connecting to the dispensing assembly 14. Preferably, the supply outlet axis 60 defines an angle which is not perpendicular to the plane 38. Most preferably, the supply outlet axis 60 defines an angle A which is greater than 0° with respect to a perpendicular line 61 extending from the plane 38.

The connecting outlet 50 is a cylindrical stub with an opening 66 (shown in FIG. 3), and defines an axis 68 substantially parallel to the plane 38 defined by the mounting pads 34. As in the inlet 46 and supply outlet 48, external threads 70 are formed on the connecting outlet 50. Advantageously, the connecting outlet 50 can also be connected to a fluid source, and act as the fitting inlet 46 if the location of the connecting outlet 50 is more convenient for connection to the fluid source. Although two outlets are disclosed, only one inlet and one outlet are necessary for practicing the present invention.

The quick disconnect coupling 64 threadably engages the supply outlet external threads 62 to sealingly connect the coupling 64 to the supply outlet 48. The coupling 64 can be any commercially available quick disconnect coupling, such as available from Hozelock Ltd, Buckinghamshire, England, Melnor Inc., Winchester, Va., and others. Preferably, the coupling 64 includes a pop-it valve which shuts off the flow of fluid through the coupling 64 when the dispensing assembly 14 is disconnected therefrom. Most preferably, the coupling 64 includes a back flow preventer which prevents the first fluid in the dispensing assembly 14 from flowing from the dispensing assembly 14 through the coupling 64.

A semicylindrical receptacle 72 is supported and spaced from the base 32 by an upper support arm 74, and intermediate support arm 73, and a pair of lower support arms 75 extending from the base 32. The receptacle 72 is coaxial with the supply outlet axis 60, and receives the dispensing assembly 14. Preferably, the receptacle 72 is sized to receive a portion of the dispensing assembly 14 and support the dispensing assembly 14 in a cantilevered arrangement while connected to the supply outlet 48 by the coupling 64. Although a semicylindrical receptacle is disclosed, the receptacle can be an shape which can receive the dispensing assembly, such as cylindrical, square, polygonal, and the like.

The support arms 73, 74, 75 extend from the base 32 to support the receptacle 72 downstream of the coupling 64. Preferably, the upper and intermediate support arms 73, 74 form a frame around the supply outlet 48, and define a frame opening 76. The frame opening 76 provides access to the supply outlet 48 and coupling 64 for actuating the disconnect feature of the coupling 64 when disconnecting the dispensing assembly 14 from the wall bracket 10. Most preferably, at least one of the support arms 75 include an engaging surface 78 which engages the dispensing assembly 14 when cantilevered from the receptacle 72. Although a plurality of support arms 73, 74, 75 are disclosed, any number of support arms can be provided to support the receptacle without departing from the scope of the present invention.

A pair of fingers 77 extending axially from the intermediate support arms 73 engage the dispensing assembly 14 secured to the wall bracket 10. The fingers 77 stabilize the dispensing assembly 14 to maintain the dispensing assembly inlet 22 in the receptacle 72. Preferably, the fingers 77 are spaced apart a sufficient distance to cradle a portion of the dispensing assembly 14 and resist twisting, or other movement, of the dispensing assembly at an angle to the supply outlet axis 60 which would inadvertently disengage the dispensing assembly 14 from the wall bracket 10.

In use, the wall bracket 10 is mounted to the wall by abutting the mounting pads 34 against the wall. The bracket 10 is secured to the wall using screws slipped through the apertures 42 formed through the pads 34. The quick disconnect coupling 64 is threadably and sealingly fixed to the supply outlet 48, and the fluid conduit 20 is connected to the fitting inlet 46, such as by threadably and sealingly connecting a flexible hose in fluid communication with the water source to the inlet 46. The connecting outlet 50 can be capped off, placed in fluid communication with the inlet of a second wall bracket, or connected to a hose for general utility use.

Once the wall bracket 10 is securely mounted to the wall and in fluid communication with the water source, the dispensing assembly 14 is mounted on the wall bracket 10. The dispensing assembly 14 is mounted on the wall bracket 10 by slipping the valve assembly inlet 22 through the wall bracket receptacle 72 until the valve assembly inlet 22 engages the quick disconnect coupling 64, such that the coupling 64 sealingly locks onto the valve assembly 18 and allows the flow of water into the valve assembly 18. Advantageously, the dispensing assembly 14 can then be operated by actuating the valve assembly trigger 26 which allows the flow of the water and concentrate through the valve assembly 18 and out of the nozzle 24.

The dispensing assembly 14 is removed from the wall bracket 10 by disengaging the quick disconnect coupling 64 from the valve assembly inlet 22. Once the coupling 64 is disconnected from the dispensing assembly 14, the valve assembly 18 is slipped in the supply outlet axial direction out of the receptacle 72.

Figure 7:
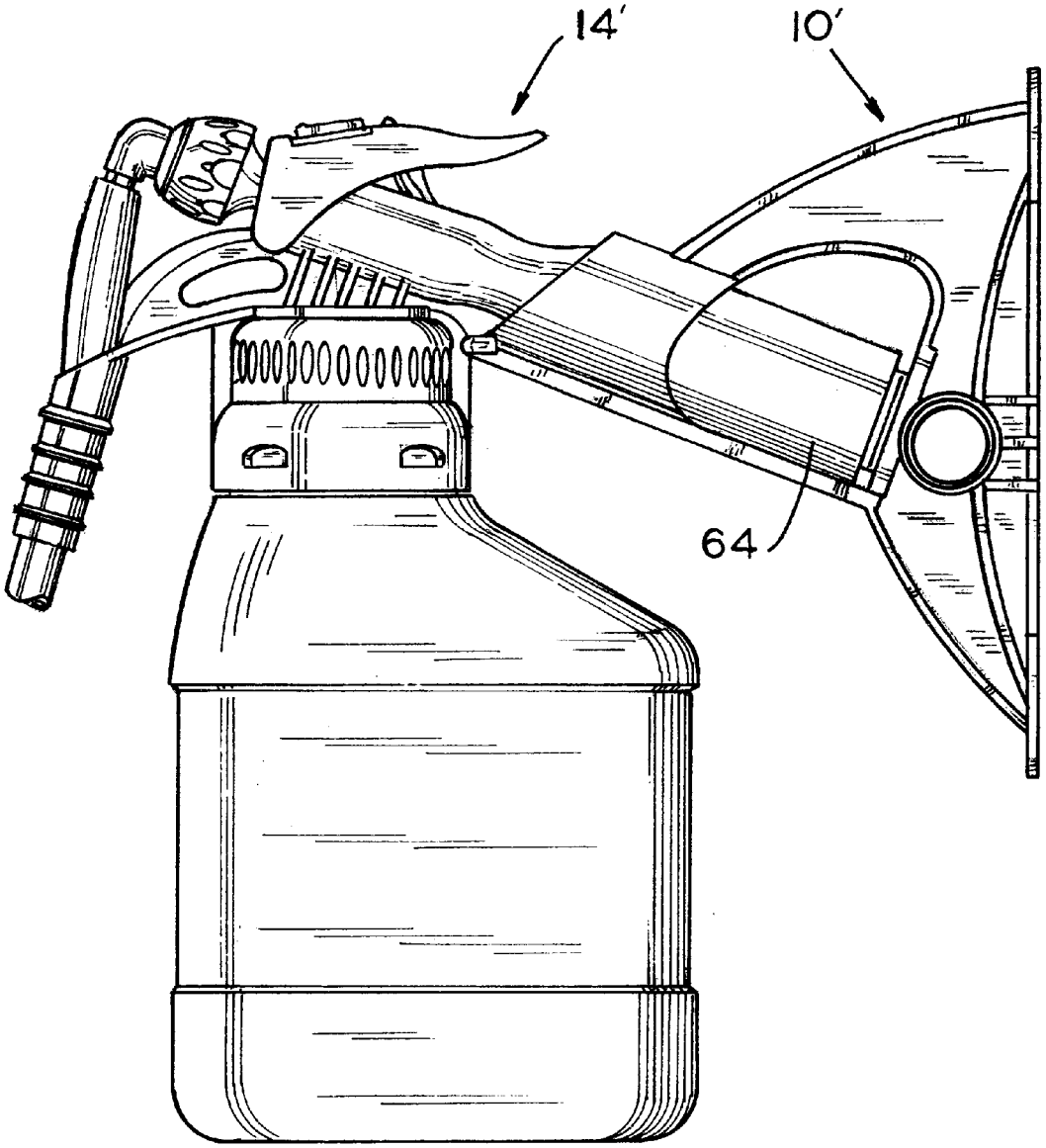
FIG. 7 is a side view of a second embodiment of a dispensing assembly wall bracket incorporating the present invention.
Figure 8:
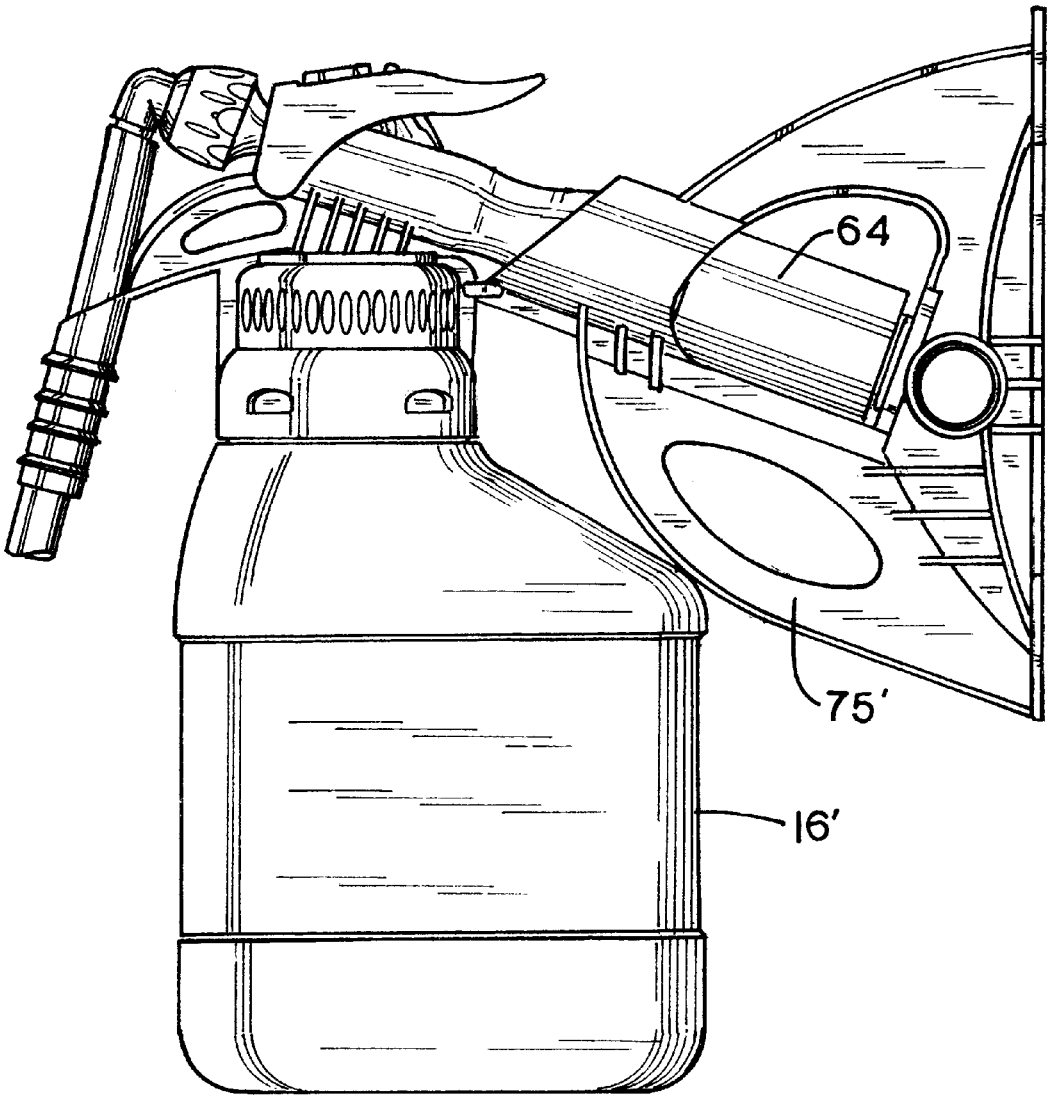
FIG. 8 is a side view of a third embodiment of a dispensing assembly wall bracket incorporating the present invention.
Figure 9:
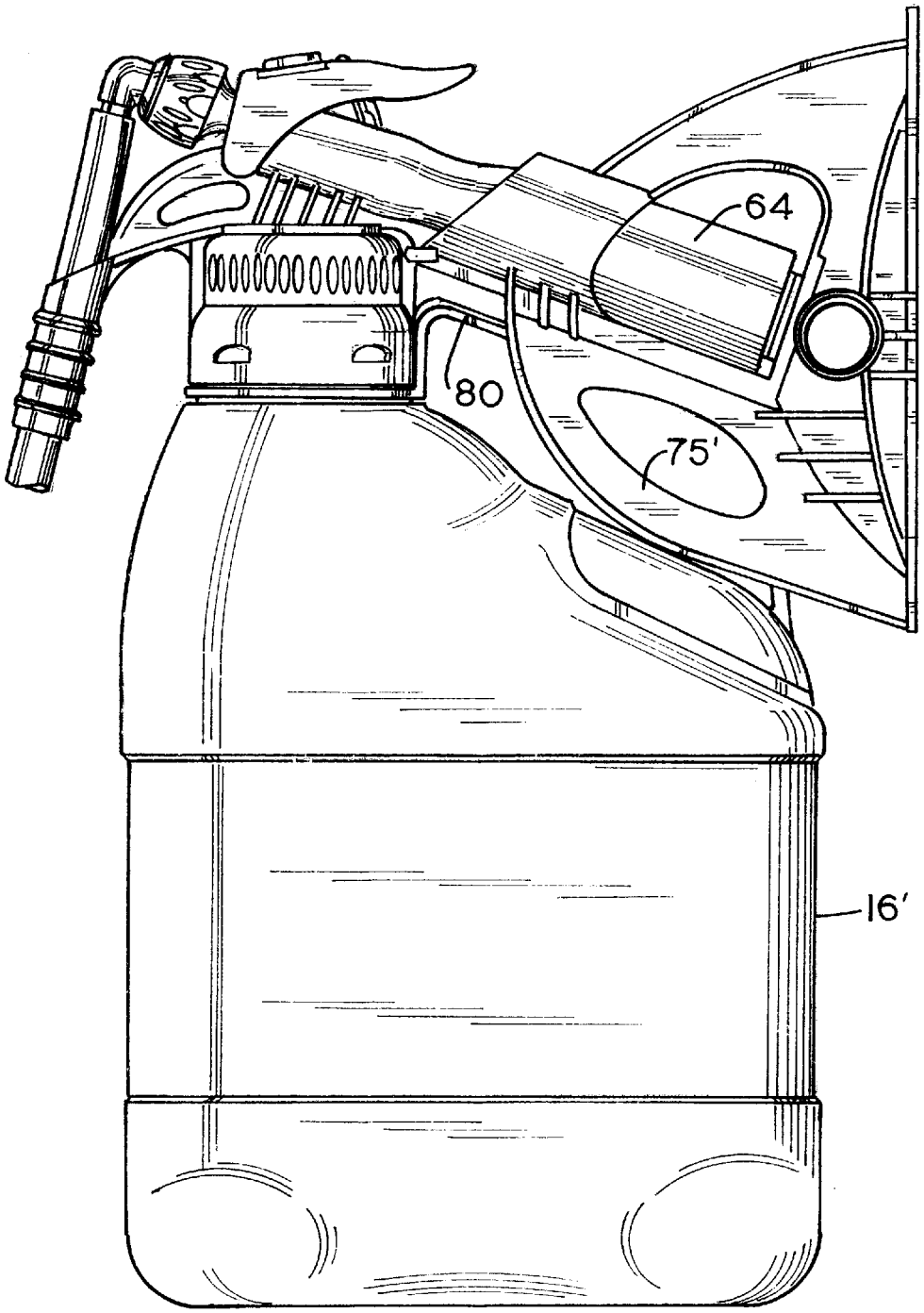
FIG. 9 is a side view of a fourth embodiment of a dispensing assembly wall bracket incorporating the present invention.

The wall bracket can also be modified to accommodate different dispensing assemblies without departing from the scope of the invention. For example, a wall bracket 10' shown in FIG. 7 is provided without a lower support arm which may interfere with the dispensing assembly 14' or is not required to support a lightweight dispensing assembly. The lower support arm 75' can also be modified to engage various shaped dispensing assembly containers 16', such as shown in FIGS. 8 and 9, or to accommodate a dispensing assembly handle 80, such as shown in FIG. 9.

The wall bracket as described herein provides several advantages to a user. The dispensing assembly is secured to the wall bracket in a convenient position to prevent damage to the dispensing assembly or fatigue to the user during filling. Each wall bracket can be clearly labeled using a label affixed to the wall, or the bracket, to reduce the chance of filling a container with the wrong product. The wall bracket can be mounted to a wall without using valuable storage or work top space, and can be secured any convenient distance above the floor.

While there has been shown and described what are at present considered the preferred embodiments of the invention, it will be obvious to those skilled in the art that various changes and modifications can be made therein without departing from the scope of the invention defined by the appended claims.

We claim:

1. A dispensing assembly wall bracket for mounting an operable dispensing assembly to an essentially vertical surface, said bracket comprising:

a base fixable to the vertical surface, and defining a plane which is substantially parallel to the vertical surface when said base is fixed thereto;

a fitting fixed to said base, and having at least one inlet and at least one outlet, said inlet defining an axis substantially parallel to said plane, and said outlet defining an axis which intersects with said inlet axis;

at least one support arm extending from said base, and having a proximal end and a distal end, said proximal end being fixed to said base; and a receptacle supported by said support arm distal end, and aligned with said outlet axis, wherein a dispensing assembly having an inlet received in said receptacle is positioned for connecting the dispensing assembly inlet to said fitting outlet.

2. The dispensing assembly wall bracket as in claim 1, in which said receptacle is cylindrical.

3. The dispensing assembly wall bracket as in claim 1, in which said fitting includes a second outlet.

4. The dispensing assembly wall bracket as in claim 1, including a connecting member sealingly connected to said outlet, for sealingly connecting the dispensing assembly to said outlet.

5. The dispensing assembly wall bracket as in claim 1, in which said outlet includes external threads for connecting to a connecting member.

6. The dispensing assembly wall bracket as in claim 1, in which said fitting inlet includes external threads for connecting to a fluid source.

7. The dispensing assembly wall bracket as in claim 1, in which said outlet axis defines a non-perpendicular angle with said plane.

8. The dispensing assembly wall bracket as in claim 1, in which said base includes at least one mounting pad which is engageable with the vertical surface.

9. The dispensing assembly as in claim 1, in which at least two support arms extend from said base and form a frame defining a frame opening which allows access to said outlet.

10. The dispensing assembly as in claim 1, in which said fitting is formed as an integral part of said base.

11. A dispensing assembly wall bracket for mounting an operable dispensing assembly to an essentially vertical surface, said bracket comprising:

a base fixable to the vertical surface, and having at least one mounting pad engageable with the vertical surface, said mounting pad defining a plane which is substantially parallel to the vertical surface when said base is fixed thereto;

a fitting fixed to said base, and having an inlet, a supply outlet, and a connecting outlet, said inlet defining an axis substantially parallel to said plane, and said supply outlet defining an axis which intersects said inlet axis;

a connecting member sealingly connected to said outlet, for sealingly connecting the dispensing assembly to said outlet;

at least two support arms extending from said base and forming a frame defining a frame opening which allows access to said outlet, at least one of said support arms having a proximal end and a distal end, said proximal end being fixed to said base; and a receptacle supported by said support arm distal end, and aligned with said outlet axis, wherein a dispensing assembly having an inlet received in said receptacle is positioned for connecting the dispensing assembly inlet to said fitting outlet.

12. An apparatus for mounting a plurality of operative dispensing assemblies to an essentially vertical surface, said apparatus comprising:

a first wall bracket having a receptacle for mounting a dispensing assembly thereon and a fitting, said fitting including an inlet connectable to a fluid source, a supply outlet for supplying the fluid to a dispensing assembly, and a connecting outlet;

a second wall bracket having a receptacle for mounting a dispensing assembly thereon and a fitting, said fitting including an inlet connectable to a fluid source and a supply outlet for supplying the fluid to a dispensing assembly; and a fluid conduit connecting said connecting outlet and said second bracket inlet, such that fluid exiting said connecting outlet is directed into said second wall bracket inlet for supplying the fluid to a dispensing assembly mounted on said second wall bracket.

13. The apparatus as in claim 12, in which said first wall bracket receptacle is cylindrical.

14. The apparatus as in claim 12, including a connecting member sealingly connected to said first wall bracket supply outlet, for sealingly connecting the dispensing assembly to said first wall bracket supply outlet.

15. The apparatus of claim 12, in which said first wall bracket comprises:

a base fixable to the vertical surface, and defining a plane which is substantially parallel to the vertical surface when said base is fixed thereto;

said fitting is fixed to said base, and said inlet defines an axis substantially parallel to said plane, and said supply outlet defines an axis substantially perpendicular to said inlet axis;

at least one support arm extending from said base, and having a proximal end and a distal end, said proximal end being fixed to said base, and said receptacle is supported by said support arm distal end, and aligned with said outlet axis.

16. The apparatus as in claim 15, in which said inlet axis defines a non-perpendicular angle with said plane.

17. The apparatus as in claim 15, in which said base includes at least one mounting pad which is engageable with the vertical surface.

18. The apparatus as in claim 15, in which at least two support arms extend from said base and form a frame defining a frame opening which allows access to said outlet.

19. The apparatus as in claim 15, in which said first wall bracket fitting is formed as an integral part of said base.

* * * * *